US009797607B2

(12) United States Patent
Kubono et al.

(10) Patent No.: US 9,797,607 B2
(45) Date of Patent: Oct. 24, 2017

(54) HEAT SOURCE SIDE UNIT FOR AIR CONDITIONING APPARATUS

(71) Applicant: Mitsubishi Electric Corporation, Tokyo (JP)

(72) Inventors: Toshiyuki Kubono, Tokyo (JP); Hiroyuki Jinnai, Tokyo (JP); Tomoya Yanase, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 165 days.

(21) Appl. No.: 14/815,196

(22) Filed: Jul. 31, 2015

(65) Prior Publication Data

US 2016/0033147 A1 Feb. 4, 2016

(30) Foreign Application Priority Data

Aug. 4, 2014 (JP) ..... 2014-158889

(51) Int. Cl.

| | |
|---|---|
| ***F25D 23/12*** | (2006.01) |
| ***F24F 1/60*** | (2011.01) |
| ***F24F 1/48*** | (2011.01) |
| ***F24F 1/10*** | (2011.01) |
| ***F24F 1/06*** | (2011.01) |
| ***F24F 1/22*** | (2011.01) |
| ***F24F 1/46*** | (2011.01) |

(52) U.S. Cl.

CPC ..... *F24F 1/60* (2013.01); *F24F 1/06* (2013.01); *F24F 1/10* (2013.01); *F24F 1/22* (2013.01); *F24F 1/46* (2013.01); *F24F 1/48* (2013.01)

(58) Field of Classification Search

CPC ..... F25B 39/02; F25B 39/022

USPC ..... 62/238, 6

See application file for complete search history.

(56) References Cited

U.S. PATENT DOCUMENTS

2010/0319380 A1* 12/2010 Mochizuki ..... F24F 1/06 62/259.1

FOREIGN PATENT DOCUMENTS

| | | | |
|---|---|---|---|
| JP | S61-70360 | A | 4/1986 |
| JP | H06-137610 | A | 5/1994 |
| JP | H08-121819 | A | 5/1996 |

(Continued)

OTHER PUBLICATIONS

Extended European Search Report dated Jan. 20, 2016 in the corresponding EP application No. 15179374.2.

(Continued)

*Primary Examiner* — Melvin Jones

(74) *Attorney, Agent, or Firm* — Posz Law Group, PLC

(57) ABSTRACT

A heat source side unit for an air conditioning apparatus includes a machine room in which a compressor is accommodated, an air-sending unit room in which an air-sending unit is accommodated, a separator for partitioning a space into the machine room and the air-sending unit room, a reactor installed in the machine room, and a reactor mounting member fixed to the separator on a side of the machine room and on which the reactor is mounted, and the reactor mounting member includes a first mounting unit and a second mounting unit corresponding to each of the reactors with the sizes different from each other, and on the reactor mounting member, the reactor is selectively mounted on either one of the first mounting unit and the second mounting unit corresponding to the size of the reactor.

7 Claims, 6 Drawing Sheets

(56) References Cited

FOREIGN PATENT DOCUMENTS

| | | | | | |
|---|---|---|---|---|---|
| JP | 2003254566 | A | * | 9/2003 | ..... F24F 5/00 |
| JP | 2009-186091 | A | | 8/2009 | |
| JP | 4675379 | B2 | | 2/2011 | |
| WO | 2007/080748 | A1 | | 7/2007 | |

OTHER PUBLICATIONS

Office Action dated May 9, 2017 issued in corresponding JP application No. 2014-158889 (and English translation).

* cited by examiner

HEAT SOURCE SIDE UNIT FOR AIR CONDITIONING APPARATUS

TECHNICAL FIELD

The present invention relates to a heat source side unit for an air conditioning apparatus.

BACKGROUND ART

Conventionally, an outdoor unit in which a reactor for executing inverter control of a compressor is installed in a machine room in which the compressor is installed is known (see Patent Literature 1, for example). In the prior-art outdoor unit, a screw hole or the like for mounting the reactor is formed in a partition plate (separator) partitioning a space into the machine room and an air-sending device room, and the reactor is directly mounted on the partition plate.

CITATION LIST

Patent Literature

Patent Literature 1: Japanese Patent No. 4675379 (page 7, FIG. 7)

SUMMARY OF INVENTION

Technical Problem

The prior-art outdoor unit as in Patent Literature 1 is constituted such that the reactor is directly mounted on the partition plate, and since the reactor with a different size cannot be mounted on the partition plate, a plurality of types of partition plates each matching the size of the reactor to be mounted on the outdoor unit are prepared.

The present invention was made in view of the problem as described above and has an object to obtain a heat source side unit for an air conditioning apparatus in which a reactor in a different size can be selectively mounted on a separator (partition plate).

Solution to Problem

The heat source side unit for an air conditioning apparatus according to the present invention includes a machine room in which a compressor is accommodated, an air-sending unit room in which an air-sending unit is accommodated, a separator partitioning a space into the machine room and the air-sending unit room, a reactor installed in the machine room, and a reactor mounting member fixed to the separator on a machine room side and on which the reactor is mounted, and the reactor mounting member includes a first mounting unit and a second mounting unit corresponding to each of the reactors with sizes different from each other, and on the reactor mounting member, the reactor is selectively mounted on either one of the first mounting unit and the second mounting unit corresponding to the size of the reactor.

Advantageous Effects of Invention

According to the heat source side unit for an air conditioning apparatus of the present invention, the reactors with different sizes can be selectively mounted on the separator.

DESCRIPTION OF EMBODIMENTS

Figure 1:
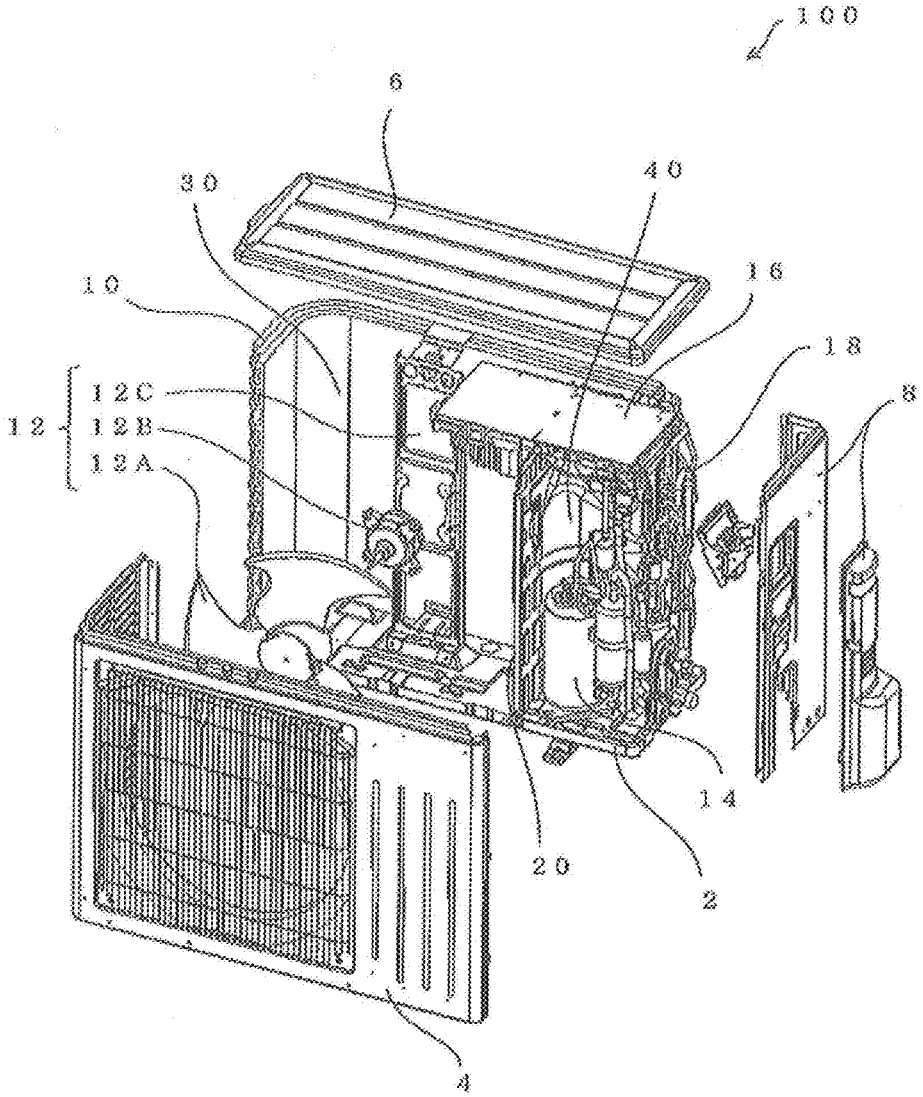
FIG. 1 is an exploded perspective view of a heat source side unit for an air conditioning apparatus according to Embodiment 1 of the present invention.

An embodiment of the present invention will be described below by referring to the attached drawings. In each figure, the same or corresponding portions are given the same reference numerals and the description will be omitted or simplified as appropriate. Moreover, regarding a constitution described in each figure, its shape, size, arrangement and the like can be changed as appropriate within a range of the present invention.

Embodiment 1

FIG. 1 is an exploded perspective view of a heat source side unit for an air conditioning apparatus according to Embodiment 1 of the present invention. A heat source side unit 100 of an air conditioning apparatus according to this embodiment (hereinafter referred to as a heat source side unit) constitutes a refrigeration cycle together with a use side unit, not shown. The heat source side unit 100 is installed outdoors, for example, and discharges or supplies heat of air conditioning.

The heat source side unit 100 has an air-sending unit room 30 and a machine room 40 partitioned by a separator 20 inside a space covered by a base member 2, an outer shell panel 4, a top surface panel 6, and a side surface panel 8. In the air-sending unit room 30, a heat exchanger 10, an air-sending unit 12 and the like are accommodated, while in the machine room 40, a compressor 14, an electrical component box 16, a refrigerant pipe 18, a reactor 50 and the like are accommodated. In FIG. 1, the reactor 50 is not shown.

The heat exchanger 10 is to perform heat exchange between a refrigerant flowing through the heat exchanger 10 and an outside air. The heat exchanger 10 has an L-shaped bent shape and is mounted on the base member 2. The air-sending unit 12 is to send an air to the heat exchanger 10 and includes a fan 12A and a motor 12B for driving the fan 12A. The motor 12B is mounted on a motor supporting member 12C mounted on the heat exchanger 10 and the base member 2 on a front of the heat exchanger 10. The air-sending unit 12 generates an air flow by suctioning the outside air from a rear surface side of the heat source side unit 100 and by blowing the air having passed through the heat exchanger 10 to the front of the heat source side unit 100.

The compressor 14 is mounted on the base member 2 and compresses the suctioned refrigerant and brings it to a high-temperature high-pressure state. The compressor 14 is constituted by a scroll-type compressor, a reciprocating-type compressor or the like, for example. The compressor 14 is driven by an inverter, not shown, and has its operation volume controlled in accordance with an air conditioning state or the like.

The electrical component box 16 is a box accommodating a substrate, an electronic component and the like and includes a power supply unit (not shown) for supplying an electric power to the heat source side unit 100, an inverter (not shown) and the like, for example. The electrical component box 16 is installed on an upper side of the machine room 40 above the compressor 14.

Figure 2:
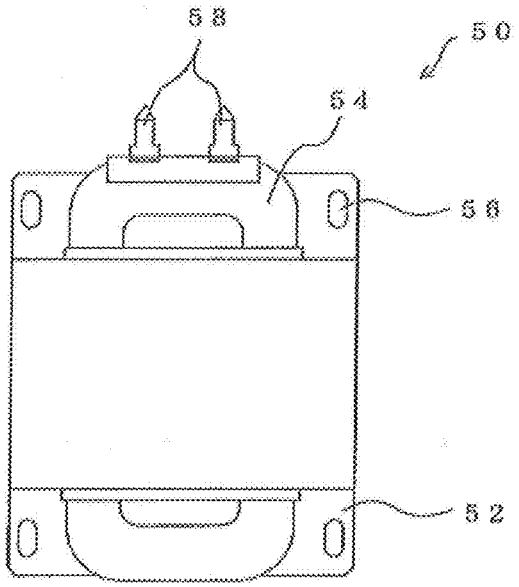
FIG. 2 is a front view of a reactor to be mounted on the heat source side unit described in FIG. 1.
Figure 3:
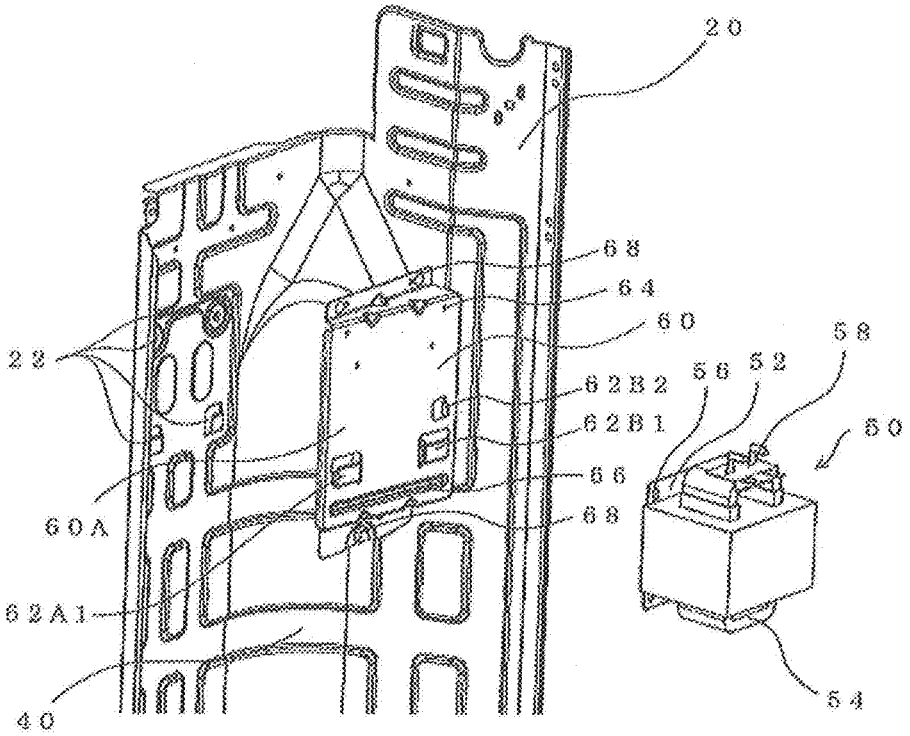
FIG. 3 is an exploded perspective view for explaining mounting of the reactor described in FIG. 2 on a separator described in FIG. 1.
Figure 4:
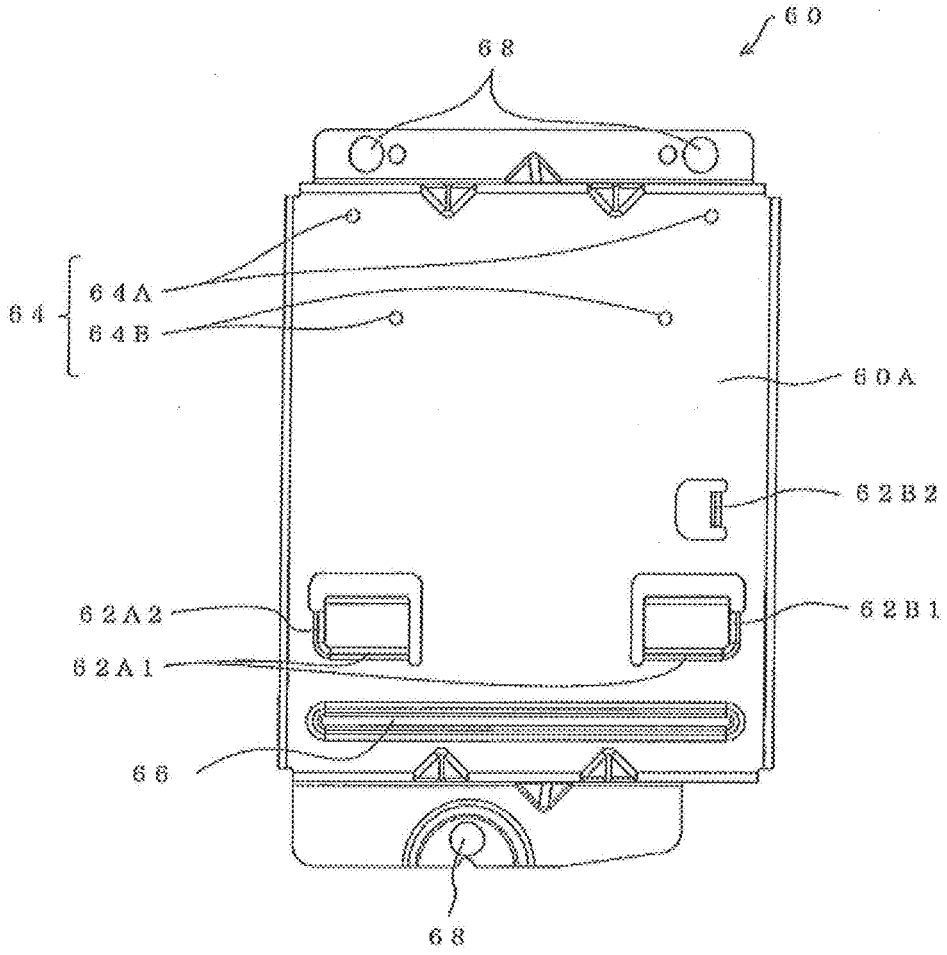
FIG. 4 is a front view of a reactor mounting member described in FIG. 3.
Figure 5:
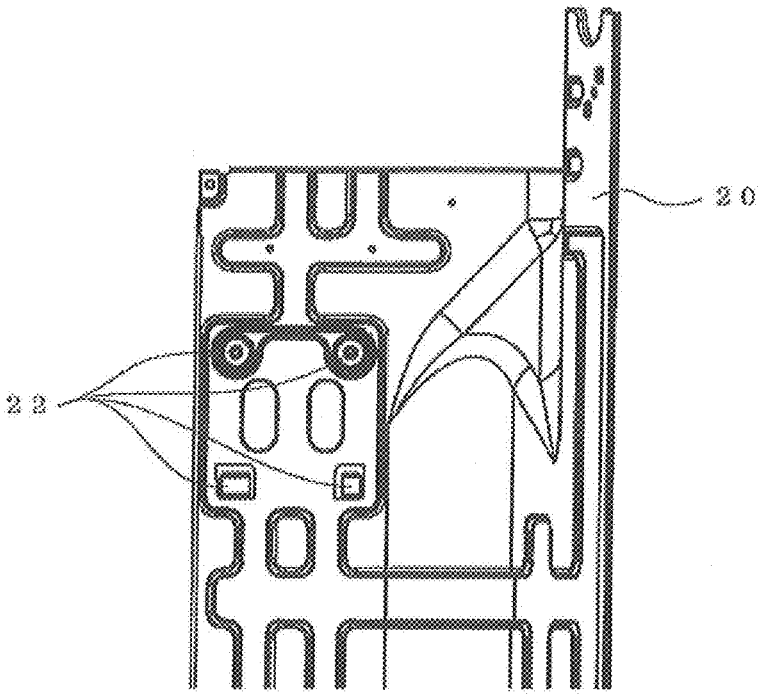
FIG. 5 is a side view illustrating a portion of the separator to which the reactor mounting member described in FIG. 3 is to be mounted in an enlarged manner.

FIG. 2 is a front view of the reactor to be mounted on the heat source side unit described in FIG. 1, FIG. 3 is an exploded perspective view for explaining mounting of the reactor described in FIG. 2 on the separator described in FIG. 1, FIG. 4 is a front view of a reactor mounting member described in FIG. 3, and FIG. 5 is a side view of a portion of a separator on which the reactor mounting member described in FIG. 3 is to be mounted in an enlarged manner. The reactor 50 described in FIG. 2 is connected to the inverter accommodated in the electrical component box 16 and has a function of removing a high frequency component or the like. The reactor 50 is installed in the machine room 40 in the vicinity of the electrical component box 16 so as to exert its function suitably. The reactor 50 has a plate-shaped base 52, a coil unit 54 installed on the base 52, and a connection terminal 58 connected to the inverter. In the base 52, a plurality of through holes 56 used for mounting on other members are formed.

As illustrated in FIG. 3, the reactor 50 is mounted on the separator 20 on the machine room 40 side through a reactor mounting member 60. In the reactor mounting member 60, a plurality of through holes 68 for fixing screws are formed, and the reactor mounting member 60 is fixed to the separator 20 by using a screw hole (not shown) formed in the separator 20. The reactor mounting member 60 may be fixed to the separator 20 by spot welding or the like. The reactor 50 is mounted on the reactor mounting member 60 fixed to the separator 20.

As illustrated in FIG. 4, the reactor mounting member 60 has a supporting unit 62A1, a left-side positioning unit 62A2, a first right-side positioning unit 62B1, a second right-side positioning unit 62B2, a plurality of screw holes 64, a protruding part 66, and the through holes 68. The supporting unit 62A1 is formed having an L-shape and supports a lower side in a gravity direction of the base 52 of the reactor 50. The supporting unit 62A1 is formed by cutting and raising, for example, but a separate member formed having an L-shape may be retrofitted by welding or the like. Since the supporting unit 62A1 is formed having an L-shape, when the reactor 50 is placed on the supporting unit 62A1, the reactor 50 does not slip or fall. In an example of this embodiment, as illustrated in FIG. 2, the coil unit 54 protrudes from the base 52 at a center on the lower side of the reactor 50. Thus, as illustrated in FIGS. 3 and 4, the supporting units 62A1 are formed at two spots so as to support the lower side of the base 52 of the reactor 50 on both sides, and the coil unit 54 is released at a center part of the reactor 50.

The left-side positioning unit 62A2 is to position the left side of the base 52 of the reactor 50. The left-side positioning unit 62A2 is formed by cutting and raising, for example, but a plate-shaped or rod-shaped separate member may be retrofitted by welding or the like. The left-side positioning unit 62A2 is welded/fixed to the supporting unit 62A1, and the supporting unit 62A1 is reinforced. The first right-side positioning unit 62B1 is to position the right side of the base 52 of the reactor 50. The first right-side positioning unit 62B1 is formed by cutting and raising, for example, but a plate-shaped or rod-shaped separate member may be retrofitted by welding or the like. The first right-side positioning unit 62B1 is welded/fixed to the supporting unit 62A1, and the supporting unit 62A1 is reinforced. The left-side positioning unit 62A2 and the first right-side positioning unit 62B1 correspond to a "pair of first positioning units" of the present invention for positioning the right and left of the reactor 50.

The second right-side positioning unit 62B2 corresponds to a "second positioning unit" of the present invention and positions the right side of the base of a "reactor with an other size" (not shown) with a size different from that of the reactor 50. The reactor 50 corresponds to a "reactor with one of sizes" of the present invention. The second right-side positioning unit 62B2 is formed so as to be capable of protruding to the reactor with an other size side between the left-side positioning unit 62A2 and the first right-side positioning unit 62B1. The second right-side positioning unit 62B2 protrudes to the reactor with the other size side when the reactor with the other size is to be mounted on the reactor mounting member 60 and does not protrude in a state in which the reactor 50 is mounted. The left-side positioning unit 62A2 protruding to the reactor with the other size side and the second right-side positioning unit 62B2 act to position right and left of the reactor with the other size. In this embodiment, the example in which the left-side positioning unit 62A2 is made common and the reactor 50 and the reactor with the other size are positioned is described, but the first right-side positioning unit 62B1 may be made common. In this case, instead of the second right-side positioning unit 62B2, a second left-side positioning unit for positioning the left side of the base of the reactor with the other size may be formed. Moreover, it may be so configured that the second right-side positioning unit 62B2 for positioning the right side of the reactor with the other size and the second left-side positioning unit for positioning the left side of the base of the reactor with the other size are provided.

The plurality of screw holes 64 are used for screwing the reactor 50 to the reactor mounting member 60. The plurality of screw holes 64 include a first screwing part 64A through which an upper side in the gravity direction of the reactor 50 is screwed and a second screwing part 64B through which the upper side in the gravity direction of the reactor with the other size different from that of the reactor 50 is screwed, for example.

As described above, the supporting unit 62A1, the left-side positioning unit 62A2, the first right-side positioning unit 62B1, and the first screwing part 64A correspond to a "first mounting unit" of the present invention on which the reactor 50 is to be mounted, while the supporting unit 62A1, the left-side positioning unit 62A2, the second right-side positioning unit 62B2, and the second screwing part 64B correspond to a "second mounting unit" of the present invention on which the reactor with the other size different from that of the reactor 50 is mounted.

As illustrated in FIGS. 3 and 5, a plurality of holes 22 for mounting the reactor 50 are formed in the separator 20 in some cases. The plurality of holes 22 communicate with the air-sending unit room 30 and thus, there is a concern that water enters the machine room 40 from the plurality of holes 22. Thus, in this embodiment, the reactor mounting member 60 is mounted on the separator 20 so as to cover the plurality of holes 22. Since the reactor mounting member 60 covers the plurality of holes 22, the concern of entry of the water into the machine room 40 is suppressed. Moreover, the reactor mounting member 60 has a protruding part 66 protruding to the separator 20 side on the lower side in the gravity direction of the plurality of holes 22, and the protruding part 66 is constituted to receive the water having entered from the plurality of holes 22 and dropped.

Figure 6:
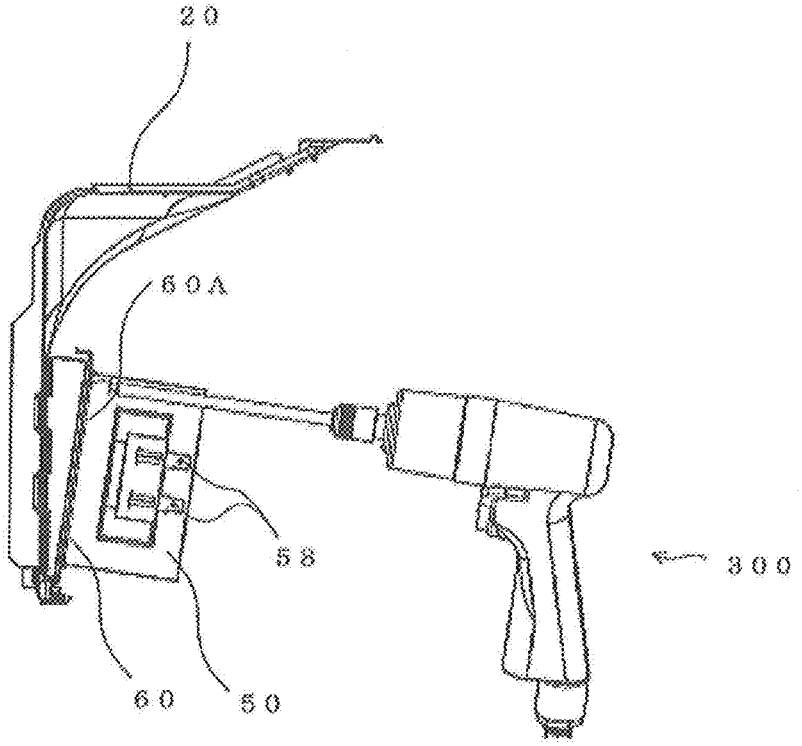
FIG. 6 is a schematic view for explaining mounting of the reactor described in FIG. 2 on the heat source side unit.

FIG. 6 is a schematic view for explaining mounting of the reactor described in FIG. 2 on the heat source side unit. In FIG. 6, for facilitation of understanding of this embodiment, the separator 20, the reactor mounting member 60, and the reactor 50 are extracted and illustrated. In FIG. 6, the lower side is on the front of the heat source side unit 100, and a worker performs an attaching/detaching work of the reactor 50 from the front in a state in which the outer shell panel 4 in FIG. 1 is removed. When the reactor 50 is to be mounted, for example, the worker first temporarily installs the reactor 50 on the reactor mounting member 60 fixed to the separator 20. That is, while positioning the right and left of the reactor 50 by the left-side positioning unit 62A2 and the first right-side positioning unit 62B1 illustrated in FIG. 4, the worker places the reactor 50 on the supporting unit 62A1. Then, by using a tool 300 such as an electric driver or the like, the worker mounts the reactor 50 on the reactor mounting member 60.

As illustrated in FIG. 6, the reactor mounting member 60 according to this embodiment has a mounting surface 60A on which the reactor 50 or a reactor (not shown) with the other size different from that of the reactor 50 is to be mounted inclined so as to be directed forward. Thus, according to this embodiment, the worker can temporarily install the reactor 50 on the reactor mounting member 60 while visually checking the mounting surface 60A. As a result, in this embodiment, the worker can perform the temporary installation work reliably and easily. Moreover, in this embodiment, the reactor 50 temporarily installed on the reactor mounting member 60 is inclined to be directed forward and thus, workability of the mounting work using the tool 300 is improved.

As described above, in this embodiment, the reactor mounting member 60 is fixed to the separator 20, and the reactor mounting member 60 is constituted so that either one of the reactor 50 and the reactor with the other size different from that of the reactor 50 can be selectively mounted. Thus, according to this embodiment, the separator 20 can be made common. Moreover, since the reactor mounting member 60 is constituted so that the reactor with the different size can be selectively mounted, freedom in selection of the reactor is improved.

Moreover, in this embodiment, the mounting surface 60A of the reactor mounting member 60 on which the reactor is mounted is inclined so as to be directed forward. As a result, according to this embodiment, the worker can mount the reactor 50 on the reactor mounting member 60 easily and reliably. Moreover, since removal of the reactor from the reactor mounting member 60 is also easy, service and maintenance and the like of the heat source side unit 100 are facilitated.

The present invention is not limited to the aforementioned embodiment but can be modified in various ways within a range of the present invention. That is, the constitution of the aforementioned embodiment may be improved as appropriate, or at least a part may be replaced by another constitution. Moreover, a constitution requirement not particularly limited to the arrangement may be arranged not only to the arrangement disclosed in the embodiment but at a position capable of achieving the function.

For example, in the aforementioned description, the reactor mounting member 60 constituted such that either one of the reactors with two types of sizes can be selectively mounted is described, but the reactor mounting member may be constituted such that any one of the reactors with three types of sizes can be selectively mounted. In this case, it is only necessary that a third right-side positioning unit for positioning the right side of the reactor with a third size and a third screwing part through which the upper side in the gravity direction of the reactor with the third size is screwed are formed on the reactor mounting member, for example. At this time, if the second right-side positioning unit 62B2 is constituted so that a protruding position can be changed, for example, the third right-side positioning unit can be omitted.

Moreover, for example, in the aforementioned description, the example in which the heat source side unit 100 includes one reactor 50 is described, but the heat source side unit may be provided with two or more reactors. In this case, it is only necessary that the heat source side unit includes two or more reactor mounting members or the reactor mounting member is constituted capable of mounting two or more reactors, for example.

REFERENCE SIGNS LIST

2 base member, 4 outer shell panel, 6 top surface panel, 8 side surface panel, 10 heat exchanger, 12 air-sending unit, 12A fan, 12B motor, 12C motor supporting member, 14 compressor, 16 electrical component box, 18 refrigerant pipe, 20 separator, 22 hole, 30 air-sending device room, 40 machine room, 50 reactor, 52 base, 54 coil unit, 56 through hole, 58 connection terminal, 60 reactor mounting member, 60A mounting surface, 62A1 supporting unit, 62A2 left-side positioning unit, 62B1 first right-side positioning unit, 62B2 second right-side positioning unit, 64 screw hole, 64A first screwing part, 64B second screwing part, 66 protruding part, 68 through hole, 100 heat source side unit, 300 tool.

The invention claimed is:

1. A heat source side unit for an air conditioning apparatus, comprising:

a machine room in which a compressor is accommodated;

an air-sending device room in which an air-sending unit is accommodated;

a separator partitioning a space into the machine room and the air-sending device room;

a reactor installed in the machine room; and a reactor mounting member fixed to the separator on a side of the machine room and on which the reactor is mounted, wherein:

the reactor mounting member includes a first mounting unit and a second mounting unit corresponding to each of the reactors with sizes different from each other, on the reactor mounting member, the reactor is selectively mounted on either one of the first mounting unit and the second mounting unit corresponding to the size of the reactor, and the reactor mounting member is inclined so that a mounting surface on which the first mounting unit and the second mounting unit are formed is directed forward.

2. The heat source side unit for an air conditioning apparatus of claim 1, wherein the reactor is connected to an inverter driving the compressor.

3. A heat source side unit for an air conditioning apparatus, comprising:

a machine room in which a compressor is accommodated;

an air-sending device room in which an air-sending unit is accommodated;

a separator partitioning a space into the machine room and the air-sending device room;

a reactor installed in the machine room; and a reactor mounting member fixed to the separator on a side of the machine room and on which the reactor is mounted, wherein:

the reactor mounting member includes a first mounting unit and a second mounting unit corresponding to each of the reactors with sizes different from each other, on the reactor mounting member, the reactor is selectively mounted on either one of the first mounting unit and the second mounting unit corresponding to the size of the reactor, the reactor has a plate-shaped base, and the first mounting unit and the second mounting unit have supporting units for supporting a lower side in a gravity direction of the base made common.

4. The heat source side unit for an air conditioning apparatus of claim 3, wherein the first mounting unit includes a pair of first positioning units for positioning right and left of the base in a state in which a reactor with one size is mounted on the first mounting unit, the second mounting unit includes a second positioning unit provided between the pair of first positioning units and protruding to a reactor with an other size side in a state in which the reactor with the other size is mounted on the second mounting unit, and the second positioning unit does not protrude in a state in which the reactor with the one size is mounted on the first positioning unit.

5. The heat source side unit for an air conditioning apparatus of claim 3, wherein the first mounting unit further includes a first screwing part through which an upper side in the gravity direction of the reactor with the one size is screwed when the reactor with the one size is mounted on the first mounting unit, and the second mounting unit further includes a second screwing part through which the upper side in the gravity direction of the reactor with the other size is screwed when the reactor with the other size is mounted on the second mounting unit.

6. A heat source side unit for an air conditioning apparatus, comprising:

a machine room in which a compressor is accommodated;

an air-sending device room in which an air-sending unit is accommodated;

a separator partitioning a space into the machine room and the air-sending device room;

a reactor installed in the machine room; and a reactor mounting member fixed to the separator on a side of the machine room and on which the reactor is mounted, wherein:

the reactor mounting member includes a first mounting unit and a second mounting unit corresponding to each of the reactors with sizes different from each other, on the reactor mounting member, the reactor is selectively mounted on either one of the first mounting unit and the second mounting unit corresponding to the size of the reactor, the separator has a hole, and the reactor mounting member covers the hole.

7. The heat source side unit for an air conditioning apparatus of claim 6, wherein the reactor mounting member further includes a protruding part protruding to the separator side on a lower side in the gravity direction of the hole.

* * * * *